US005857722A

United States Patent [19]

Ayotte

[11] Patent Number: 5,857,722

[45] Date of Patent: Jan. 12, 1999

[54] CONFORMABLE BAG HOLDER WITH FLAT FRAME STORAGE

[76] Inventor: Bertrand J. Ayotte, 38 Glen St., Augusta, Me. 04330

[21] Appl. No.: 664,668

[22] Filed: Jun. 17, 1996

[51] Int. Cl.[6] ..... B65B 67/12

[52] U.S. Cl. ..... 294/1.1; 248/97; 248/99; 383/33

[58] Field of Search ..... 294/1.1, 1.3–1.5, 294/50.8, 51, 55; 15/257.1, 257.4; 141/313, 316, 390, 391; 248/97, 99–101; 383/33, 34, 34.1

[56] References Cited

U.S. PATENT DOCUMENTS

| | | | |
|---|---|---|---|
| 3,688,484 | 9/1972 | Cox | 294/50.8 |
| 3,796,402 | 3/1974 | Trotta | 248/101 |
| 3,934,803 | 1/1976 | Paulus, Jr. | 294/1.1 |
| 4,815,866 | 3/1989 | Martone | 294/1.1 |
| 4,991,386 | 2/1991 | Dirksen | 294/50.8 |
| 5,022,767 | 6/1991 | Cardulla | 383/33 |
| 5,058,839 | 10/1991 | Stevens | 248/97 |

*Primary Examiner*—Dean Kramer
*Attorney, Agent, or Firm*—Stan Jones, Patents

[57] ABSTRACT

A holding and raking apparatus designed to facilitate a one person operation for bagging leaves into a held open bag. The holding apparatus stores flat when not in use in order to minimize storage space. Rigid frame sides and conformable top and bottom frame rails allows the frame to be bowed temporarily into essentially a hollow semi-cylindrical shape which is held in that bowed condition by a retaining or securing strap. The lawn clipping and leaf system is further complemented by specially designed scissors-type rake. These raketongs are attached at a pivot point by a clamp or similar fastening apparatus. The raketongs pick leaves up and place them in a vertically positioned bag held in the frame by a natural spring tension at the open top of the frame. In a horizontal position on the ground the taut end of the open bag acts as a dust pan rail for easy collection of leaves and the like.

18 Claims, 1 Drawing Sheet

CONFORMABLE BAG HOLDER WITH FLAT FRAME STORAGE

BACKGROUND OF THE INVENTION

1. Field of the Invention

The field of the invention relates to a method and apparatus for raking and bagging leaves. In a more limited sense, the field of the invention relates to a conformable frame which positions and holds a leaf bag open and accessible in either a vertical or horizontal position, thereby significantly improving the bag handling and the ensuing leaf to bag transfer.

Furthermore, the field of the invention includes, as an option, a scissors-like, dual rake head which acts as a leaf clamping device to facilitate pick up and deposit in a bag held by the conformable frame.

This invention significantly improves and simplifies the age old leaf handling problem and creates a hands free bag holding operation. Efficiency of operation is significantly improved with a device and system approach which positions the bag in an open configuration thereby freeing the user to handle the leaves and rake without holding the bag.

Definition of Terms

Stored Configuration.

The Stored Configuration refers to the absolutely flat position an open frame takes when a Tension Cord is not attached to create a half circle configuration. The Stored Configuration reduces the physical volumetric size of the apparatus when not in use.

Flexed Configuration.

A Flexed Configuration allows the user to conform the apparatus into the shape required for leaf bag attachment.

Constraint Cord.

The Constraint Cord is a cable, string, or similar material which constrains the frame in the open configuration with an open end flexed for self gripping a bag for receiving lawn clippings, leaves and the like.

Bag Open End.

After tensioning the frame into an open ended half cylinder shape and placing the leaf bag on the bag holding conformed frame, the open end of the bag receives the leaves. This likewise refers to the end of the bag holding frame on which the plastic leaf bag is wrapped around the half-circle frame. When so affixed, the bag is held open by the bag holder apparatus and is ready for receipt of the leaves.

Tension Cord End.

After the upper frame opening has been configured into essentially a half-cylinder/circle configuration, the opposing end of the frame includes a Tension Cord which is attached at the bottom near one of the side struts. This end is positionally located near or in conjunction with the hermetically sealed end of a standard commercially available garbage bag.

Longitudinal, Non-flexing Member.

These are the narrow shorter members of the flat framing structure that are made of a substantially rigid or nonflexible material that run parallel to the length bag and perpendicular to the bag's open or closed end.

Flexible Members.

These are the narrow longer members of the flat framing structure that are made of a flexible material that enable the user to temporarily form the frame into a half circle or hollow semi-cylindrical shape for holding a plastic bag in an open leaf-receiving condition.

Raketongs.

This is a scissors-type configuration consisting of two lawn rakes attached together by easily separable swivel clamps or by a bolt and nut combination that is located in a hole drilled through a pair of ordinary rake handles.

2. DESCRIPTION OF PRIOR ART

Bag holders have been developed over the years for holding lawn trimmings. These holders are usually affixed to mowers for mobile operations, or are often attached directly to the machinery in a circular or rectangular fashion with various bands or clips, and other supporting apparatus. Similar bagging arrangements exist for mulchers, and the like.

However, none provide the positioning characteristics and hands free user operation of the LEAF BOW™ invention described and claimed herein. The LEAF BOW accomplishes its function without the use of bag holding clips or other securing apparatus, and without attachment to other supporting machinery.

For sake of comparison, before this invention many homeowners attempted a leaf bagging operation by first placing a standard bag inside a large plastic trash can. At first, this appears to be a viable alternative. However, this technique is fraught with several failure modes.

One failure mode is caused by the bag construction itself. In today's economy, the manufacturing thickness (commonly referred to in the industry as mil thickness) has continued to decrease, with the average bag only capable of supporting a volume of medium to lightly packed leaves.

When one uses this plastic trash can method, it is not uncommon to place too many leaves into the bag. In such an instance the leaves are forced into the bag against the trash can sides. And then the leaf bag cannot be pulled out of the inside of the plastic trash can without structural failure of the bag. Often times, the bag breaks open, rips or tears due to the outward pressing forces of the overstuffed bag against the rigid, fixed, non-giving sides of the plastic trash can.

Moreover, the removal problem is further compounded by the vacuum effect created by the overstuffed bag working against the walls of the plastic trash can. When this occurs, the frustrated homeowner must start the entire operation over—dump out the failed bag and leaves, replace a new bag in the trash can,—and then re-bag the same pile of leaves.

In short, bagging of lawn clippings, leaves and the like, can be—and is—a time consuming and frustrating proposition. Although a problem of long standing, the prior art simply has not offered a ready and simple solution to this problem. This invention offers a ready, simple and easy to use method and apparatus for solving this long standing and unsolved problem.

SUMMARY OF THE INVENTION

In the normal day-to-day process of raking and bagging leaves by the homeowner, an operational difficulty arises after the raking process has been completed and one is attempting to transition the raked leaves into a manageable size lawn and leaf bag. The invention solves this problem in that an open rectangular bag frame, made of narrow, thin members is resiliently conformable at the top and bottom. The frame has rigid members at the frame sides, stores flat but then is conformable into a hollow semi-cylindrical bag holding shape for readily receiving clippings into normal lawn and leaf bags held on the conformable frame.

The invention solves the yard use problem of positioning standard, commercial leaf bags in an open configuration ready to receive the leaves, lawn clippings and other similar debris.

The invention may be configured by the user for use in either a vertical or a horizontal position—thereby allowing the user the option of raking inward with a standard yard rake, or setting the apparatus vertically and filling a lawn and leaf bag from the top by raketongs when the bag has been secured to the leaf bag racking invention.

The invention design will hold a range of plastic bag sizes. Sizes may range from 20 to 50 gallon plastic bags (or other bag types, for example burlap or corded nylon). Possessing inherent variable tensioning characteristics of the novel conformable framing and tethering apparatus for the bag frame, this invention creates a simple and expedient way of bag attachment without clips or bindings.

A subtle, but significant design benefit of the LEAF BOW™ is that the open frame design forgives over-stuffing, and precludes the bag from "sticking" as in the trash can method described above. With an open expandable sided configuration for bags held by this conformable frame design invention, a filled bag can always be readily removed from the apparatus.

Thus, my LEAF BOW positions and holds a leaf bag open in a horizontal or a vertical freestanding position wherein both hands of the user are free. Accordingly, the user may transition leaves into a bag on the invention's conformable frame by hand, a single-handle rake or use of a scissor tonged rake pair.

OBJECTS OF THE INVENTION

It is an object of the invention to provide a conformable frame holding device for lawn and leaf bags.

It is an object of the invention to provide such a frame holding device for holding a leaf bag in an open position either horizontally or vertically.

It is an object of the invention to hold a leaf bag open with the sides of leaf bag unrestrained in a frame which allows the user to have both hands free to work.

It is an object of the invention to provide a bag holding configuration wherein the bag may be positioned horizontally with the plane of the opening vertical and the held bag assuming a semi-cylindrical shape.

It is an object of the invention to provide a bag holding configuration wherein the bag may be positioned vertically with the sides of the bag remaining unrestrained and the bag opening being held horizontal.

It is an object of the invention to provide a bag holding configuration such that, with the bag positioned vertically, and the plane of the opening horizontal, the bag assembly is stable, yet freestanding.

It is an object of the invention to provide an apparatus which is functional with different size leaf bags.

It is an object of the invention to provide a tensioning cord which sets a conformable frame to a given bag size.

It is an object of the invention to provide a bow assembly of sufficient flexure so as to pre-tension and hold a bag to a bag holder frame without requiring the use of bag clips or bindings.

It is an object of the invention to provide a spring tensioned element to accommodate the opening of the bag.

It is an object of the invention to provide a flexible material which conforms the frame of a leaf bag holder.

It is an object of the invention to provide an open receptacle to use a standard rake to sweep leaves into the bag holder.

It is an object of the invention to provide a conformable frame which may be stored flat in a compact storage space when the frame is not in use.

It is an object of the invention to incorporate resilient conformable top and bottom frame elements such that, upon removal of a wrapped top portion of the bag, the top portion of the apparatus will spring wide, thereby allowing easy extraction of an overstuffed bag.

It is an object of the invention to be able to use raketongs to pick leaves up in a clamping, grasping method for use with a conformable frame.

DESCRIPTION OF PREFERRED EMBODIMENT (S)

Figure 1:
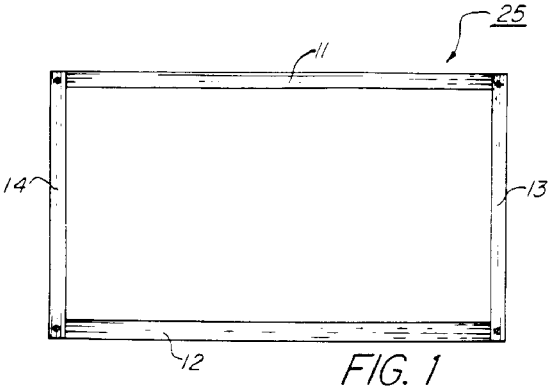
FIG. 1 is a plan view of the lawn and leaf bag frame of the invention in a flat, pre-tensioned condition for compact storage.
Figure 2:
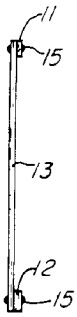
FIG. 2 is a side view of the flat frame of this invention.
Figure 3:
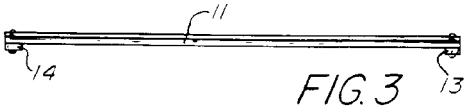
FIG. 3 presents an end or bottom view of the flat frame of this invention.
Figure 4:
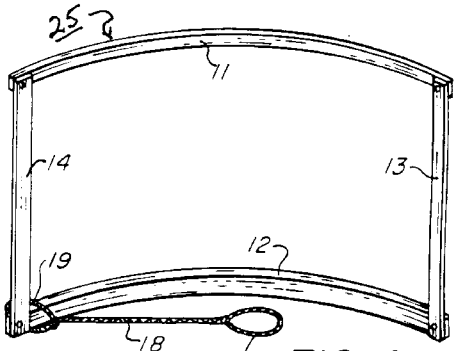
FIG. 4 is a front perspective view showing the invention's frame slightly bowed and also depicting a tension cord.

FIGS. 1, 2, and 3 respectively present plan, side, and end views of the leaf bag frame invention 25 when the frame is flattened for storage purposes. FIG. 4 is a front perspective view showing a slight bow being formed in the frame 25 by a bend in the resilient conformable top and bottom struts 11 and 12. As earlier described, the invention provides a flat storage profile and yet easily conforms to essentially a hollow semi-cylindrical shape when the user is desirous of placing the frame 25 in use for collecting leaves and the like.

Turning now to FIG. 1, sides 11 and 12 may be approximately ⅛" to ½" thick and approximately 1" to 1½" wide, depending on the flexibility of the material used. These sides are essentially rigid in order to provide a stand alone capability when the frame 25 is put into use.

As shown in FIG. 2, bag holder frame 25 can be attached together with bolts, rivets or the like 15, with one fastener each being located at the top bottom and side cross piece locations. (FIG. 1 shows such fasteners positioned at the corners of the of the essentially rectangular frame 25.) Additionally, of course, these corner locations sides, top and bottom could also all be molded as one piece. Such one-piece molding would, however, restrict the folding and storage features of the invention.

FIG. 3 shows the side view along the longitudinal plane of the bag holder frame 25. For an even more compact storage use, the corner fasteners could be loosened and the rectangle of FIG. 1 may be converted into a parallelogram and collapsed inwardly upon itself. This collapse of the frame crossway through a parallelogram results in a straight line storage position for collapsed frame 25. Additionally, cord 18 may easily be slid to the middle, of the collapsed frame where it may be wrapped around the collapsed parallelogram. That resulting compact and neat storage arrangement is a novel feature not previously provided by any known leaf frame art.

Turning now to FIG. 4, a front perspective view of one embodiment of the invention is shown. The frame assembly 25 is comprised of rigid, longitudinal elements 13 and 14, along with flexible elements 11 and 12. These four elements are pinned at their extremities by bolts 15 so as to form essentially a square or a rectangle.

A tensioning cord 18 is captured at one corner of the open rectangular frame through loop 19 during final assembly of the rectangle frame 25. A slight bow has begun to take place in FIG. 4 as the frame is being conformed into a fully bowed configuration of FIG. 5 for use.

Figure 5:
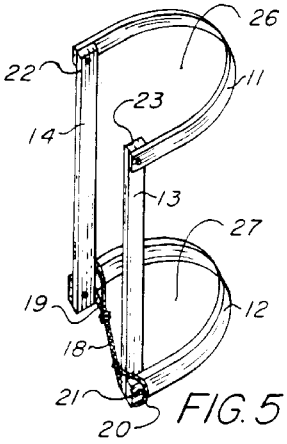
FIG. 5 is a side perspective view of the inventive frame showing the tensioning cord attached to both bottom frame corners.

Turning now to FIG. 5, a side perspective view of one embodiment is shown with frame 25 conformed in a tensioned mode. Flexible elements 11 and 12 are bowed back on themselves and are secured in tension by loop 18. End loop 20 of tension cord 18 is positioned around opposite frame corner 21. Thus tensioning cord 18, in conjunction with bow loops 19 and 20, have been selected with dimensions that will achieve a pre-set conformed curvature in flexible elements 11 and 12.

In the tensioned configuration, of FIG. 5, corners 22 and 23 are free to spring outward at a distance wider than the length of tensioning cord 18 as a result of the flexing forces within element 11. I use this natural tendency to spring apart to my advantage, since that natural tendency is employed as a force for grabbing and securing the leaf bag 16 when it is placed with the open end across the bowed top curvature rail 11.

Pursuant to FIG. 5, top and bottom elements 11 and 12 are made of a material such as plastic or flexible metal, which, when bent, forms a half hoop or bow shape. With tension cord 18 attached as shown, the framing 25 takes a curved shape as presented in FIG. 5. In use, the invention conforms into a user-controlled, hollow semicircular opening 26 out of frame member 11 and a corresponding semicircular opening 27 with flexible element 12. The spring tension of member 11 continues to push upper frame corners 22 and 23 outward, thereby providing working tension for a taut condition of mouth 30 of bag 16.

Figure 6:
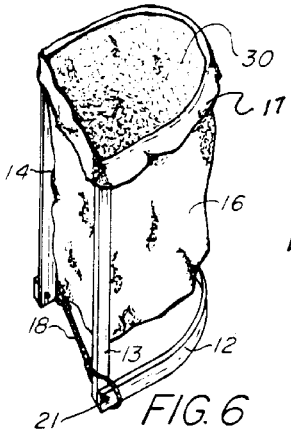
FIG. 6 is a perspective view of the bag frame of the invention with a bag in place vertically with bag sides unrestrained and the bag held in a semi-cylindrical shape by the frame.

Turning now to FIG. 6, the bag holder apparatus 25 is shown in a vertical position. The amount of flexure and outward opening of end elements 11 and 12 and the length of side rails 14 and 15 are of a pre-designed length so as to accommodate a wide variation in standard commercial lawn, grocery garbage and/or leaf bags. In order for the user to place a new empty leaf bag in place on the bowed frame, the user applies a slight, inward pressure while rolling the top 17 of a bag 16 over element 11. When the user releases inward pressure from the upper corners 22 and 23 (FIG. 5) the bag 16 is captured in a full open position.

Additionally, as the bag 16 is wrapped and doubled over at 17 around element 11, a double strength of the top opening 30 of the bag 16 is effected. Indeed, if the user so desires, the top 17 of bag 16 may advantageously be folded several inches over and outside the top of frame 25 as best shown in FIG. 6. The outward springing nature for upper end 11 of frame 25 holds bag 16, FIG. 6, from slipping off frame 25 and with bag sides unrestrained for a full filling for bag 16. At the same time, the invention serves to hold bag 16 open in an upright position making it easy to fill bag 16 with leaves by using raketongs 50 of FIG. 8.

Figure 7:
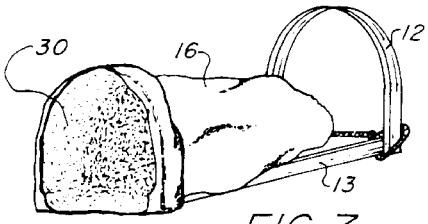
FIG. 7 is a perspective view of the invention of FIG. 6 with the bag in an open, horizontal, leaf-receiving position.

FIG. 7 shows the frame invention in a horizontal position. The semi-circular shape for the bowed leaf bag frame 25 provides a flat side for the invention and that flat side may act as a dust pan rail to allow the leaves and grass clippings to easily be raked into the held bag 16. Please note that while the frame 25 is on the ground with the flat part of the semi-cylindrical shape located on the surface to be cleaned, the flat side of bag 16 is taut all along its width at the top 17. Thus bag 16 is tightly held between upper corners 22 and 23 by the sprung nature of the restraining cord at the bottom side only. This horizontal position of FIG. 7 is highly advantageous to a user because a user can easily rake leaves into the bag 16 while it is held in an open horizontal condition.

Figure 8:
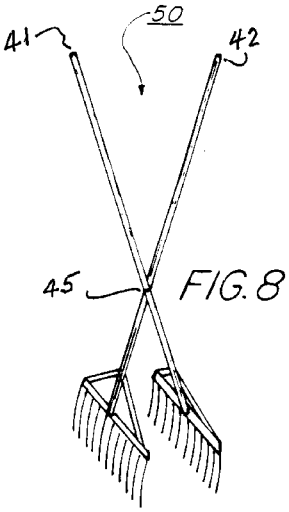
FIG. 8 is a side perspective view of an optional scissors rake, or raketongs, for leaf pick up in combination with the inventive conformable frame method and apparatus.

As shown in FIG. 8, the rake tongs 50 consist of two individual rakes 41 and 42. Rakes 41 and 42 are pinned together at pivot point 45. The pivot may take any number of forms so long as it allows the rakes to operate in a scissors style fashion. Both individual rakes are offset somewhat by the pivot 45 such that the raking tines 46 interleave with each other. Such interleaving creates a clamping mode between the two rakes in order to grasp the leaves for easy clean pickup and deposit into my conformable frame bag holder 25.

While my invention has been described with reference to a particular example of a preferred embodiment, it is my intention to cover all modifications and equivalents within the scope of the following claims. It is therefore requested that the following claims, which define my invention, be given a liberal interpretation which is within the spirit and scope of my contribution to this art.

What is claimed is:

1. A bag holding apparatus comprising:

a four sided bag-holding frame in an essentially open rectangular shape, with said frame having resilient, conformable cross pieces at the top and bottom of the frame;

essentially rigid side members at the frame sides, corner fastening means fastening the top and bottom cross pieces with said side members at the corners of said frame such that said frame stores flat but is conformable into an essentially hollow semi-cylindrical bag holding shape when put into use for receiving a bag to be held on the conformable frame;

a tensioning member fastened at one lower corner and running from said one lower corner to the opposite lower corner for holding said frame in a bowed shape for receiving said bag at an open end; and a bowed sprung open end in said essentially semicircular shape by an unrestrained bow in the upper cross piece for receiving the open end of a bag to be held by said frame.

2. A bag holding apparatus in accordance with claim 1 for plastic bags and further comprising:

a length selected for said top and bottom cross pieces to hold standard commercial plastic bags ranging from 20 to 50 gallon sizes in an open configuration ready to receive leaves, lawn clippings and other similar debris.

3. A bag holding apparatus in accordance with claim 1 in a bowed shape wherein said bottom cross piece and said tensioning member further comprises:

a loop formed in the end of said tensioning member for looping same over an opposite lower corner of said frame, wherein said frame may be configured in a bowed shape at both of said cross pieces for use in either a vertical or a horizontal position when a bag has been secured to the bag holding frame.

4. A bag holding apparatus in accordance with claim 3 in a bowed shape wherein said bowed top cross piece further comprises:

a spring-like tension created in the bowed shape of the top cross piece for expanding outwardly against the open top of a plastic bag placed thereon for holding said bag in place on said frame without use of clips or bindings.

5. A bag holding apparatus in accordance with claim 4 having an open top of a plastic garbage, lawn and/or leaf bag held in a bowed shape and wherein said open frame design alleviates over-stuffing of said bag, and said bag holding apparatus further comprises an open sided arch configuration defined between the conformable top and bottom cross pieces for holding a bag held by said conformable frame with said bag sides hanging freely in said open arch.

6. A bag holding apparatus in accordance with claim 5 and said apparatus further comprises:

a flat plane formed by said essentially rigid side members along the bowed sides of the top and bottom cross pieces of said frame for holding a bag in an open position when said frame and bag are placed horizontally with the sides of the bag being unrestrained, and thus allowing a user to have both hands free for placing debris in said bag.

7. A bag holding apparatus in accordance with claim 3 having an open top of a lawn and leaf bag held in a bowed shape by the bowed cross pieces of said bag holding frame, and said apparatus further comprises:

with the frame sides positioned vertically, and the plane of the bag opening horizontal, a bag holding apparatus wherein the held bag is vertically stable, yet free standing with the descending sides of said bag unrestrained.

8. A lawn and leaf bag holding apparatus in accordance with claim 7 having an open top of a plastic lawn and leaf bag held in a bowed shape by the upper bowed cross piece of said bag-holding frame, and said apparatus further comprises:

said upper cross piece, when conformed into said bowed shape, upon removal of a wrapped top portion of a held bag, being spring-loaded to automatically spring further open so as to thereby allow easy extraction of an overstuffed bag from said frame.

9. A bag holding apparatus in accordance with claim 1 and further comprising:

a flat storage profile for said frame when the frame is not in use; and said upper and lower cross pieces of said frame are made of narrow resilient strips that are easily conformable to essentially a hollow semi-cylindrical shape when the user is desirous of placing the frame in use for collecting debris.

10. A bag holding apparatus in accordance with claim 10, said frame further comprising:

means for loosening said corner fastening means such that said rectangle may be converted into a parallelogram and collapsed inwardly upon itself; and such collapse of the frame crosswise from a rectangle to a parallelogram results in a straight line storage position for said collapsed frame.

11. A bag holding apparatus in accordance with claim 10, said frame further comprises:

said tensioning member comprises a cord including means being slidable to the middle of the collapsed frame whereby said cord may be wrapped around said collapsed parallelogram.

12. A method of bagging lawn clippings, leaves and other debris, comprising the steps of:

storing a rectangular-shaped four sided bag-holding frame having an essentially open rectangular shape in a flat condition;

providing across the top and bottom of said frame a pair of upper and lower resilient, conformable cross pieces;

fastening a pair of rigid side members of equal length as the frame sides to said pair of upper and lower cross pieces, joining said fastened top and bottom cross pieces to said side pieces at the corners of said frame such that said frame stores flat but is conformable into a hollow semi-cylindrical bag holding shape when ready for use; and bending said conformable cross-pieces back upon themselves such that said rectangular frame is bowed into an essentially hollow semi-cylindrical shape for holding an open bag on the conformable frame.

13. A method in accordance with claim 12 and further comprising the additional steps of:

attaching a tensioning strap at one lower corner of said conformed frame; and extending said strap from said one lower corner to the opposite lower corner of said frame in order to hold said frame in said bowed shape.

14. A method in accordance with claim 13 and further comprising the additional steps of:

forming a loop in the end of said tensioning strap for looping same over said opposite lower corner of said frame, whereby said frame may be configured by the user into said hollow semi-cylindrical shape for use in either a vertical or a horizontal position when a bag has been secured to the bag-holding frame.

15. A method in accordance with claim 13 and further comprising the additional steps of:

securing a standard plastic bag at one end of said conformed frame by the ordered steps of:

first, bowing a non-strapped end of said frame with the corners moving toward one another in a bowed shape;

next placing the open end of a standard plastic bag over the bow-shaped end;

rolling the top of the bag to form an open bag end therein; and releasing the corners of the frame such that the natural spring in the bowed shape holds the open end of the bag taut in an open condition.

16. A plastic bag holding apparatus for flat compact storage and a bowed shape for holding standard sized garbage, leaf and/or lawn bags, such apparatus comprising:

a four-cornered, bag-holding frame in an essentially flat open shape, with said frame having resilient, conformable upper and lower cross pieces at the top and bottom of the frame and essentially rigid members at the sides of the frame, a tensioning member running from one lower corner to an opposite lower corner of said frame, with said tensioning member selected with a length suitable for holding said flat frame in a bowed shape that is adapted to receive and hold plastic bags in an open condition; and a bowed open end in the conformable upper cross piece of said bowed frame for receiving the open end of a plastic bag, which bag is held in place by a tendency of said bowed cross piece to spring outwardly.

17. A bag holding apparatus in accordance with claim 16 wherein said open frame design alleviates over-stuffing of said bag, and said bag holding apparatus further comprises an open sided arch configuration defined between the conformable top and bottom cross pieces and the side members for holding a bag with the sides of the bag hanging freely in said open arch configuration.

18. A bag holding apparatus in accordance with claim 17 wherein said frame is rectangular in shape further comprising:

fastening means at each of said corners for allowing said rectangular frame to be converted into a parallelogram when collapsed inwardly upon itself; and such collapse results in an essentially straight line storage condition for said collapsed frame.

* * * * *